US009920416B2

(12) United States Patent
Katayama et al.

(10) Patent No.: US 9,920,416 B2
(45) Date of Patent: Mar. 20, 2018

(54) BLACKENING TREATMENT SOLUTION FOR BLACK CR—CO ALLOY PLATING FILM

(71) Applicant: OKUNO CHEMICAL INDUSTRIES CO., LTD., Osaka-shi, Osaka (JP)

(72) Inventors: Junichi Katayama, Osaka (JP); Shingo Nagamine, Osaka (JP); Ryuichi Tamura, Osaka (JP)

(73) Assignee: OKUNO CHEMICAL INDUSTRIES CO., LTD., Osaka-shi (JP)

( * ) Notice: Subject to any disclaimer, the term of this patent is extended or adjusted under 35 U.S.C. 154(b) by 512 days.

(21) Appl. No.: 14/395,091

(22) PCT Filed: Apr. 18, 2013

(86) PCT No.: PCT/JP2013/061446

§ 371 (c)(1),
(2) Date: Oct. 17, 2014

(87) PCT Pub. No.: WO2013/168528

PCT Pub. Date: Nov. 14, 2013

(65) Prior Publication Data

US 2015/0090368 A1 Apr. 2, 2015

(30) Foreign Application Priority Data

May 9, 2012 (JP) ..... 2012-107572

(51) Int. Cl.

| | |
|---|---|
| ***C23C 22/58*** | (2006.01) |
| ***C23C 8/40*** | (2006.01) |
| ***C25D 5/48*** | (2006.01) |
| ***C25D 9/08*** | (2006.01) |
| ***C25D 3/04*** | (2006.01) |
| ***C25D 3/06*** | (2006.01) |
| ***C25D 3/56*** | (2006.01) |
| ***C23C 8/42*** | (2006.01) |
| *C23C 22/00* | (2006.01) |

(52) U.S. Cl.

CPC ..... *C23C 8/40* (2013.01); *C23C 8/42* (2013.01); *C23C 22/58* (2013.01); *C25D 3/04* (2013.01); *C25D 3/06* (2013.01); *C25D 3/562* (2013.01); *C25D 5/48* (2013.01); *C25D 9/08* (2013.01)

(58) Field of Classification Search

None

See application file for complete search history.

(56) References Cited

U.S. PATENT DOCUMENTS 5,556,715 A * 9/1996 Yoshimi ..... B23K 35/226 428/457

FOREIGN PATENT DOCUMENTS

| | | | |
|---|---|---|---|
| JP | 33-02120 | B2 | 3/1958 |
| JP | 45-24844 | B | 8/1970 |
| JP | 45-24844 | | 9/1970 |
| JP | 49-3609 | | 1/1974 |
| JP | 49-3609 | B2 | 1/1974 |
| JP | 61-253383 | A | 11/1986 |
| JP | 6-252281 | A | 9/1994 |
| JP | 8-311687 | A | 11/1996 |
| JP | 9-95793 | A | 4/1997 |
| JP | 3302120 | B2 | 7/2002 |
| JP | 2002-285375 | A | 10/2002 |
| JP | 2003-213446 | A | 7/2003 |
| JP | 2007-531820 | A | 11/2007 |
| JP | 2010-196100 | A | 9/2010 |
| WO | 2006/004299 | A1 | 1/2006 |

OTHER PUBLICATIONS

Changmei Ke, et al., "A Trivalent Chromium Black Passivation Process for Potassium Chloride Zinc-Plating Layer", Materials Protection, vol. 45, 2012, No. 2, pp. 28-30 and 60, with English translation.

Office Action dated Nov. 24, 2015, issued in counterpart Chinese patent application No. 201380022278.2, with English translation. (12 pages).

Office Action dated Jun. 1, 2016, issued in counterpart Korean Patent Application No. 10-2014-7031256, with English translation. (7 pages).

International Search Report dated May 28, 2013, issued in corresponding application No. PCT/JP2013/061446.

* cited by examiner

*Primary Examiner* — Lois Zheng

(74) *Attorney, Agent, or Firm* — Westerman, Hattori, Daniels & Adrian, LLP

(57) ABSTRACT

The present invention provides a blackening treatment method for a black Cr—Co alloy plating film, the method comprising bringing a black Cr—Co alloy plating film having a Cr content of 1 to 15 wt. % into contact with a blackening treatment solution comprising an aqueous solution with a pH value of −1 to 5. According to the present invention, the blackish color of a less blackish plating film formed from a plating bath containing trivalent chromium is enhanced to further improve decorativeness. Furthermore, the corrosion resistance of the film can be more improved by performing electrolytic chromate treatment after blackening treatment.

13 Claims, No Drawings

BLACKENING TREATMENT SOLUTION FOR BLACK CR—CO ALLOY PLATING FILM

TECHNICAL FIELD

The present invention relates to a blackening treatment solution for black Cr—Co alloy plating films, and a blackening treatment method of a black Cr—Co alloy plating film.

BACKGROUND ART

Black-colored films are used in various fields, such as accessories, due to their excellent appearance. They are also used in various optical instrument parts, measuring instrument parts, etc., by taking advantage of their low reflectivity. Various films, including chromium-, nickel-, zinc-, aluminum-, and iron-based films, are known as black-colored films. Various methods, including chemical treatment and anodic oxidation, are known as the method for forming such films.

In particular, black chromium plating is widely used as the method for forming black films (see PTL 1, PTL 2, and PTL 3, listed below). Plating baths used in these black chromium plating methods contain hexavalent chromium ions; however, the toxicity of hexavalent chromium has recently become an issue. In terms of the working environment and waste water treatment, there is a strong demand for the development of plating solutions with low toxicity. Therefore, black plating from a trivalent chromium bath with low toxicity has been spreading as an alternative technology (see PTL 4 and PTL 5, listed below).

However, compared to black plating films obtained from a hexavalent chromium bath, the color of films obtained from a trivalent chromium plating bath is less blackish, and is a dark brown that is close to black. More blackish films are demanded in terms of decorativeness.

CITATION LIST

Patent Literature

PTL 1: JPS33-2120B
PTL 2: JPS45-24844B
PTL 3: JPS49-3609
PTL 4: JP2002-285375A
PTL 5: JPH09-95793A

SUMMARY OF INVENTION

Technical Problem

The present invention was made in view of the current state of the above prior art. A primary object of the present invention is to provide a method that can impart a more blackish color to less blackish plating films formed from a plating bath containing trivalent chromium, thereby further improving the decorativeness of the films.

Solution to Problem

The present inventors conducted extensive research to achieve the above object. As a result, the present inventors found that when a Cr—Co alloy plating film containing a specific amount of Cr, among black plating films formed from a plating bath containing trivalent chromium, was treated with an acidic aqueous solution having a pH value in the range of −1 to 5, the blackish color of the film could be significantly enhanced, thereby forming a black plating film with an excellent appearance. The present inventors further found that when the black plating film, whose blackish color was enhanced by this method, was subsequently subjected to electrolytic chromate treatment, the corrosion resistance of the film could be significantly improved, while the excellent appearance was maintained, thereby forming a black film having an excellent appearance and excellent corrosion resistance. The present invention has thus been completed.

That is, the present invention provides the following blackening treatment method of a black Cr—Co alloy plating film, and the blackening treatment solution for Cr—Co alloy plating films.

Item 1. A blackening treatment method for a black Cr—Co alloy plating film, the method comprising bringing a black Cr—Co alloy plating film having a Cr content of 1 to 15 wt. % into contact with a blackening treatment solution comprising an aqueous solution with a pH value of −1 to 5.

Item 2. The blackening treatment method according to Item 1, wherein the black Cr—Co alloy plating film is a film formed by electroplating from a Cr—Co alloy plating bath containing a cobalt compound and a compound containing trivalent chromium at a weight ratio Cr/Co of 2 to 60.

Item 3. The blackening treatment method according to Item 1 or 2, wherein the blackening treatment solution comprising an aqueous solution with a pH value of −1 to 5 contains hydrochloric acid and/or sulfuric acid as an acid component.

Item 4. The method according to any one of Items 1 to 3, wherein the step of bringing a black Cr—Co alloy plating film into contact with a blackening treatment solution is a step of immersing an article having the black Cr—Co alloy plating film in the blackening treatment solution.

Item 5. The method according to any one of Items 1 to 4, wherein the black Cr—Co alloy plating film contains 5 to 15 wt. % of phosphorus.

Item 6. A blackening treatment method for a black Cr—Co alloy plating film, the method comprising performing electrolytic chromate treatment after performing blackening treatment of a black Cr—Co alloy plating film by the method according to any one of Items 1 to 5.

Item 7. A blackening treatment solution for a black Cr—Co alloy plating film, the solution comprising an aqueous solution with a pH value of −1 to 5.

Item 8. The blackening treatment solution for a black Cr—Co alloy plating film according to Item 7, the solution containing hydrochloric acid and/or sulfuric acid as an acid component.

Item 9. An article having a black Cr—Co alloy plating film subjected to blackening treatment by the method according to any one of Items 1 to 6.

The present invention is described in detail below.

Object to be Treated

The black plating film to be treated with the blackening treatment solution of the present invention is a black Cr—Co alloy plating film having a Cr content in the range of 1 to 15 wt. % formed from a plating bath containing trivalent chromium.

When the black Cr—Co alloy plating film having such a specific Cr content is subjected to blackening treatment by a method described later, the blackish color of the film can be enhanced, without impairing the evenness of the appearance, thereby forming a black plating film with an excellent appearance.

The method for forming a black Cr—Co alloy plating film having a Cr content in the range of 1 to 15 wt. % is not particularly limited; however, particularly when the treatment target is a Cr—Co alloy plating film formed from a Cr—Co alloy plating bath that satisfies the following conditions, the blackish color of the plating film can be significantly enhanced by performing the blackening treatment described later.

Specifically, particularly when the treatment target is a black Cr—Co alloy plating film formed from a Cr—Co alloy plating bath containing a cobalt compound and a compound containing trivalent chromium at a weight ratio (Cr/Co) of 2 to 60, preferably 3 to 50, and more preferably 5 to 20, the blackish color of the film can be significantly enhanced, thereby forming a highly decorative black Cr—Co alloy plating film with an excellent appearance.

Specific examples of such a Cr—Co alloy plating bath include plating baths comprising an aqueous solution containing, in addition to a cobalt compound and a trivalent chromium-containing compound, a complexing agent, a reducing agent, a conductive salt, a pH buffer, etc. Among these components, examples of cobalt compounds include cobalt sulfate, cobalt chloride, cobalt nitrate, cobaltous acetate, and the like. Examples of trivalent chromium compounds include chromium sulfate, chromium chloride, chromium nitrate, chromium acetate, and the like. Examples of complexing agents include organic acids, such as monocarboxylic acids (e.g., formic acid and acetic acid) and salts thereof, dicarboxylic acids (e.g., oxalic acid, malonic acid, and maleic acid) and salts thereof, and hydroxycarboxylic acids (e.g., citric acid, malic acid, and glycolic acid) and salts thereof; inorganic compounds, such as urea, thiocyanogen, and cyanic acid; and the like. Examples of reducing agents include hypophosphorous acid, ascorbic acid, and water-soluble salts thereof (sodium salt, potassium salt, ammonium salt, etc.), dimethyl amine borane (DMAB), and the like. Examples of conductive salts include sodium sulfate, potassium sulfate, ammonium sulfate, sodium chloride, potassium chloride, ammonium chloride, and the like. Examples of pH buffers include boric acid, sodium borate, aluminium sulfate, and the like.

The concentrations of these components in the bath are not particularly limited. Within the range in which the weight ratio of the cobalt compound and the trivalent chromium-containing compound (Cr/Co) in the bath is 2 to 60, for example, the concentration of the cobalt compound is about 1 to 50 g/L, and the concentration of the trivalent chromium compound is about 5 to 500 g/L. Further, the concentration of the complexing agent is, for example, about 5 to 200 g/L, the concentration of the reducing agent is about 2 to 100 g/L, the concentration of the conductive salt is about 30 to 300 g/L, and the concentration of the pH buffer is about 10 to 100 g/L.

The plating conditions when using the above Cr—Co alloy plating bath are also not particularly limited. Any conditions that allow formation of black Cr—Co alloy plating films having a Cr content in the range of 1 to 15 wt. % can be used. For example, plating can be performed at a pH of about 2 to 5, preferably about 2.5 to 4, at a bath temperature of about 25 to 60° C., preferably about 30 to 55° C., and at a cathode current density of about 1 to 20 A/dm$^2$, preferably about 5 to 15 A/dm$^2$.

When a compound containing phosphorus, such as hypophosphorous acid or a salt thereof, is used as a reducing agent, the formed Cr—Co alloy plating film contains phosphorus up to about 15 wt. %. In the present invention, particularly when a Cr—Co alloy plating film containing about 5 to 15 wt. % of phosphorus is subjected to the blackening treatment described later, an excellent black appearance can be obtained in a wide range of current density.

Blackening Treatment Method

In the present invention, when the above black Cr—Co alloy plating film having a Cr content in the range of about 1 to a 15 wt. % is brought into contact with a blackening treatment solution comprising an aqueous solution having a pH value of about −1 to 5, preferably about −1 to 2, and more preferably about −0.5 to 1, an excellent blackish appearance can be imparted to the black Cr—Co alloy plating film, without impairing the appearance of the film. When the pH of the blackening treatment solution is overly high, the blackish color of the black Cr—Co alloy plating film cannot be sufficiently enhanced even by performing the treatment under the below-mentioned conditions. In contrast, a pH value of the blackening treatment solution lower than the above range is not preferred, not only because the blackish color of the black Cr—Co alloy plating film cannot be sufficiently enhanced, but also because the film has an uneven film appearance, i.e., unevenness. The above pH values are measured using a commercially available pH meter at a solution temperature of 25° C.

The blackening treatment solution comprising an aqueous solution having a pH value of −1 to 5 may be any aqueous solution having a pH within the predetermined range. For example, the pH can be adjusted to the predetermined range using an inorganic acid and/or organic acid. Specific examples of inorganic acids include hydrochloric acid, sulfuric acid, nitric acid, phosphoric acid, hydrofluoric acid, boric acid, and the like. Specific examples of organic acids include aliphatic monocarboxylic acids, such as formic acid and acetic acid; aliphatic dicarboxylic acids, such as oxalic acid, malonic acid, and succinic acid; aliphatic hydroxy monocarboxylic acids, such as gluconic acid; aliphatic hydroxy dicarboxylic acids, such as malic acid; aliphatic hydroxy tricarboxylic acids, such as citric acid; and other carboxylic acids. These inorganic acids and organic acids can be used singly or in a mixture of two or more.

The amount of inorganic acid and/or organic acid added is not particularly limited, and they may be suitably added so as to satisfy the above pH range. Generally, the amount thereof is about 1 to 100 g/L, and preferably about 5 to 50 g/L.

In the present invention, a blackened film with an excellent appearance can be formed particularly by using sulfuric acid and/or hydrochloric acid to adjust the pH value of the blackening treatment solution within the above range. Further, the corrosion resistance of the film is significantly improved by performing the electrolytic chromate treatment described later. When sulfuric acid and/or hydrochloric acid are used, the amount thereof added may be controlled so as to achieve the above pH value by using them. For example, when sulfuric acid is used, the amount of 98% sulfuric acid added is about 5 to 300 mL/L, and preferably about 20 to 100 mL/L.

As the blackening treatment method of a black Cr—Co alloy plating film using the above blackening treatment solution, it is only necessary to bring a black Cr—Co alloy plating film having a Cr content in the range of 1 to 15 wt. %, which is the treatment target, into contact with the blackening treatment solution comprising an aqueous solution having a pH value of −1 to 5. Thereby, the blackish color of the black Cr—Co alloy plating film can be enhanced, without impairing the appearance of the film, and an excellent blackish appearance can be imparted.

The method for bringing a black Cr—Co alloy plating film into contact with a blackening treatment solution is not particularly limited. For example, the treatment can be efficiently performed by immersing an article having a black Cr—Co alloy plating film in a blackening treatment solution. Although the solution temperature of the treatment solution is not particularly limited, the solution temperature is, for example, about 10 to 80° C., and preferably about 30 to 60° C. When the bath temperature is within this range, an excellent black appearance can be imparted, without impairing the appearance of the plating film, etc., by performing immersion treatment under the below-mentioned conditions. In contrast, an overly low bath temperature is not preferred, because a sufficient black appearance is not obtained. On the other hand, an overly high bath temperature is also not preferred, because unevenness of color tone is likely to occur.

Regarding the immersion treatment time, sufficient blackening is not observed when the treatment time is extremely short. In contrast, a treatment time longer than necessary is not preferred, because the film appearance may be impaired. Accordingly, the immersion time is generally about 30 seconds to 20 minutes, and preferably about 1 minute to 10 minutes.

Electrolytic Chromate Treatment

In the present invention, the corrosion resistance of the Cr—Co alloy plating film, which has been subjected to blackening treatment in the above manner, can be significantly improved, without impairing the excellent black appearance, by performing electrolytic chromate treatment on the Cr—Co alloy plating film after blackening treatment. In particular, when blackening treatment is performed using a blackening treatment solution having a pH of about −0.5 to 1, a blackened film having high corrosion resistance can be obtained by performing electrolytic chromate treatment.

Specific conditions of electrolytic chromate treatment are not particularly limited. The electrolysis treatment can be performed using a known electrolytic chromate solution within the range that does not impair the excellent black appearance.

An example of the treatment solution used for electrolytic chromate treatment is an aqueous solution containing a chromium compound, such as chromic acid, chromic acid anhydride, sodium dichromate, or potassium dichromate, and optionally containing sulfuric acid, etc. The chromium concentration in the treatment solution is, for example, about 2.5 to 50 g/L. The electrolysis treatment may be performed at a pH value of about 1.0 to 5.5 at a treatment temperature of about 20 to 70° C. at a cathode current density of about 0.1 to 2 A/dm$^2$ for about 10 seconds to 5 minutes. Although the anode is not particularly limited, for example, Pb, a Pb—Sn alloy, etc., can be used.

Advantageous Effects of Invention

The blackening treatment solution used in the blackening treatment method of the present invention does not contain a hexavalent chromium compound. Moreover, the black Cr—Co alloy plating film, which is the treatment target, is formed from a plating solution that does not contain a hexavalent chromium compound.

Therefore, according to the blackening treatment method of the present invention, plating films with an excellent black appearance can be formed, without using environmentally hazardous substances, such as hexavalent chromium.

Since the formed black plating films are highly decorative plating films with an excellent black appearance and low reflectance, they can be effectively used for various applications.

Moreover, the corrosion resistance of the films can be significantly improved, without impairing their excellent black appearance, by performing electrolytic chromate treatment after blackening treatment. As a result, the films can be effectively used for various applications as black films with an excellent appearance and excellent corrosion resistance.

DESCRIPTION OF EMBODIMENTS

The present invention is described in more detail below with reference to Examples.

EXAMPLE 1

Brass plates with a bright nickel plating film having a film thickness of 5 μm formed thereon were used as test samples, and black Cr—Co alloy plating films were formed using Cr—Co alloy plating solutions having the compositions shown in Table 1 below.

The reflectance of the formed Cr—Co alloy plating films was measured by a colorimeter. The reflectance was measured in the wavelength range of 400 to 700 nm. The reflectance measurement results were shown as ranges from the minimum reflectance to the maximum reflectance in the wavelength range of 400 to 700 nm.

Thereafter, the test samples were immersed in blackening treatment solutions having the compositions shown in Table 1 to perform blackening treatment. The treatment conditions are as shown in Table 1 below. NaOH was used when the pH of the blackening treatment solutions was increased.

Subsequently, the reflectance of each test sample after blackening treatment was measured by a colorimeter in the same manner as in the above method. It is indicated that the lower the reflectance value is, the more blackish the plating film is.

Further, the appearance of the cobalt plating films after blackening treatment was evaluated by visual observation. Films with a uniform black appearance were expressed as "A," and films with slight unevenness after blackening treatment were expressed as "B."

Table 1 below shows the results.

TABLE 1

| | | Sample 1 | Sample 2 | Sample 3 | Sample 4 |
|---|---|---|---|---|---|
| Cr—Co alloy plating | 40% Chromium (III) sulfate | 184 ml/L | 276 ml/L | 244 ml/L | |
| | $Cr^{3+}$ | 30 g/L | 45 g/L | 40 g/L | |
| | Cobalt Sulfate | 23.8 g/L | 14.3 g/L | 9.5 g/L | 19.0 g/L |
| | Co | 5 g/L | 3 g/L | 2 g/L | 4 g/L |
| | Cr/Co in bath | 6 | 15 | 20 | 10 |
| | Citric acid | 40 g/L | | 80 g/L | |

TABLE 1-continued

| | | Sample 1 | Sample 2 | Sample 3 | Sample 4 |
|---|---|---|---|---|---|
| | Ascorbic acid | 20 g/L | 5 g/L | 10 g/L | 5 g/L |
| | Boric acid | 50 g/L | 35 g/L | 50 g/L | |
| | Sodium sulfate | 150 g/L | 250 g/L | | |
| | Current density | 10 A/dm$^2$ | | 8 A/dm$^2$ | |
| | Bath temperature | 55° C. | 35° C. | 45° C. | |
| | pH | 3.5 | 3.8 | 3 | 2.8 |
| | Plating time | 10 min | | | |
| | Cr content of film | 2.0 wt % | 1.8 wt % | 3.5 wt % | 3.0 wt % |
| | Reflectance of film | 20-23% | 20-23% | 20-23% | 20-23% |
| Blackening treatment | Sulfuric acid | | 2 g/L | 1 g/L | |
| | Hydrochloric acid | | 1 g/L | 2 g/L | |
| | Malic acid | 10 g/L | | | |
| | Acetic acid | | 30 g/L | | 10 g/L |
| | pH | 2.5 | 3.5 | 4.5 | 1.8 |
| | Treatment temperature | 50° C. | 60° C. | 50° C. | 20° C. |
| | Treatment time | 10 min | 5 min | 5 min | 10 min |
| Evaluation of film | Reflectance | 8-12% | 12-14% | 15-20% | 12-14% |
| | Film appearance | A | A | A | A |

As is clear from the above results, when Samples 1 to 4 were subjected to blackening treatment after formation of Cr—Co alloy plating films thereon, the reflectance of the plating films was reduced, without impairing the appearance of the films, and black plating films with a uniform appearance were formed.

EXAMPLE 2

Brass plates with a bright nickel plating film having a film thickness of 5 μm formed thereon were used as test samples, and plating treatment was performed using a Cr—Co alloy plating bath comprising an aqueous solution with a pH of 3.5 containing 184 ml/L of 40% chromium sulfate, 140 g/L of potassium sulfate, 14.3 g/L of cobalt sulfate, 40 g/L of boric acid, and 10 g/L of sodium hypophosphite, at a bath temperature of 50° C. at a cathode current density of 10 A/dm$^2$ for 10 minutes, thereby forming black Cr—Co alloy plating films having a film thickness of about 1.0 μm. The obtained Cr—Co alloy plating films contained Co: about 80 wt %, Cr: about 2 wt %, P: about 7 wt %, 0: about 7 wt %, and C: about 4 wt %.

Subsequently, aqueous solutions containing 10 g/L of malic acid and having pH values adjusted with sulfuric acid were used as blackening treatment solutions. The samples with a Cr—Co alloy plating film formed thereon were immersed in the treatment solutions at a solution temperature of 50° C. for 10 minutes to perform blackening treatment.

Each sample after blackening treatment was subjected to electrolytic chromate treatment using a commercially available electrolytic chromate treatment solution (trade name: ECB-Y, produced by Okuno Chemical Industries Co., Ltd.). The main component of the electrolytic chromate treatment solution was sodium dichromate. The treatment conditions were as follows: ECB-Y 100 ml/L solution (chromium concentration: 0.7 g/L), pH of treatment solution: 3.5, bath temperature: 25° C. (RT), cathode current density: 0.5 A/dm$^2$, and treatment time: 1 minute.

The appearance of each sample after electrolytic chromate treatment was evaluated by visual observation. Samples with a uniform black appearance were expressed as "A," samples with yellow discoloration were expressed as "B," and samples with severe discoloration and unevenness were expressed as "C."

Further, each sample was subjected to a corrosion resistance test (CASS test) according to JIS H8502 using a CASS tester for 24 hours, and the corrosion resistance of each sample after the test was evaluated by the rating number (RN) based on the total corrosion area percent. Samples with no rust on their entire surface are scored as rating number (RN) 10. It is indicated that the lower the rating number (RN) is, the higher the corrosion area percent is. Table 2 below shows the results.

TABLE 2

| | | After electrolytic chromate treatment | |
|---|---|---|---|
| Sample No. | pH value of blackening treatment solution | Film appearance | Corrosion resistance CASS 24 hr (RN) |
| 5 | 2.5 | A | 4 |
| 6 | 2 | A | 7.5 |
| 7 | 1.5 | A | 9 |
| 8 | 1 | A | 9.5 |
| 9 | 0.5 | A | 9.5 |

As is clear from the above results, it was confirmed that the corrosion resistance after electrolytic chromate treatment was significantly improved particularly when blackening treatment was performed using blackening treatment solutions having a pH value of 1 or less.

EXAMPLE 3

Samples with a Cr—Co alloy plating film formed thereon in the same manner as in Example 2 were subjected to blackening treatment using, as a blackening treatment solution, an aqueous solution with a pH value of -0.1 containing 200 mL/L of 35% hydrochloric acid, at a solution temperature of 40° C., while changing the treatment time from 2 to 10 minutes.

Subsequently, after electrolytic chromate treatment was performed under the same conditions as Example 2, the film appearance and corrosion resistance were evaluated in the same manner as in Example 2. Table 3 below shows the results.

TABLE 3

| Sample No. | Blackening treatment time (min) | After electrolytic chromate treatment: Film appearance | After electrolytic chromate treatment: Corrosion resistance CASS 24 hr (RN) |
|---|---|---|---|
| 10 | 2 | A | 7.5 |
| 11 | 4 | A | 9.5 |
| 12 | 6 | A | 9.5 |
| 13 | 8 | A | 9 |
| 14 | 10 | C (peeled after treatment) | — |

As is clear from the above results, the corrosion resistance of the films after electrolytic chromate treatment was particularly excellent when the blackening treatment time was within the range of 4 minutes to 6 minutes.

EXAMPLE 4

Samples with a Cr—Co alloy plating film formed thereon in the same manner as in Example 2 were subjected to blackening treatment using blackening treatment solutions having a pH value adjusted with 98% sulfuric acid within the range of −0.32 to 0.45, at a solution temperature of 40° C., while changing the treatment time from 3.5 to 8 minutes.

Subsequently, after electrolytic chromate treatment was performed under the same conditions as Example 2, the film appearance and corrosion resistance were evaluated in the same manner as in Example 2. Table 4 below shows the results.

TABLE 4

| Sample No. | Blackening treatment: Sulfuric acid concentration (ml/L) | Blackening treatment: pH | Blackening treatment: Treatment time (min) | After electrolytic chromate treatment: Appearance | After electrolytic chromate treatment: Corrosion resistance CASS 24 hr (RN) |
|---|---|---|---|---|---|
| 15 | 20 | 0.45 | 8 | A | 9.0 |
| 16 | 40 | 0.15 | 5 | A | 9.5 |
| 17 | 60 | −0.07 | 4.5 | A | 9.5 |
| 18 | 80 | −0.2 | 4 | A | 9.5 |
| 19 | 100 | −0.32 | 3.5 | A | 9.5 |

As is clear from the above results, the appearance and corrosion resistance of the films after electrolytic chromate treatment were both excellent when blackening treatment solutions having a pH value adjusted with sulfuric acid were used.

EXAMPLE 5

Samples with a Cr—Co alloy plating film formed thereon in the same manner as in Example 2 were immersed in a blackening treatment solution comprising an aqueous solution with a pH value of 0 containing 50 mL/L of 98% sulfuric acid, at a solution temperature of 40° C. for 5 minutes to perform blackening treatment.

Subsequently, after electrolytic chromate treatment was performed using the same electrolytic chromate treatment solution as that of Example 2 at a cathode current density of 0.5 A/dm$^2$ at a solution temperature of 25° C. for an electrolytic chromate treatment time of 10 seconds to 3 minutes, the film appearance and corrosion resistance were evaluated in the same manner as in Example 2. Table 5 below shows the results.

TABLE 5

| Sample No. | Blackening treatment conditions | Electrolytic chromate (time) | After electrolytic chromate treatment: Appearance | After electrolytic chromate treatment: Corrosion resistance CASS 24 hr (RN) |
|---|---|---|---|---|
| 20 | Sulfuric acid | 10 sec | A | 2 |
| 21 | 50 ml/L, | 30 sec | A | 3 |
| 22 | 40° C., 5 min | 1 min | A | 9 |
| 23 | | 2 min | A | 9.5 |
| 24 | | 3 min | B | 7 |

As is clear from the above results, excellent corrosion resistance was imparted particularly when the treatment time of electrolytic chromate was within the range of 1 to 2 minutes under the treatment conditions in Example 5.

The invention claimed is:

1. A blackening treatment method for a black Cr—Co alloy plating film, the method comprising bringing a black Cr—Co alloy plating film having a Cr content of 1 to 15 wt. % into contact with a blackening treatment solution comprising an aqueous solution with a pH value of −1 to 5.

2. The blackening treatment method according to claim 1, wherein the black Cr—Co alloy plating film is a film formed by electroplating from a Cr—Co alloy plating bath containing a cobalt compound and a compound containing trivalent chromium at a weight ratio Cr/Co of 2 to 60.

3. The blackening treatment method according to claim 1, wherein the blackening treatment solution comprising an aqueous solution with a pH value of −1 to 5 contains an organic acid and/or inorganic acid as an acid component.

4. The method according to claim 1, wherein the step of bringing a black Cr—Co alloy plating film into contact with a blackening treatment solution is a step of immersing an article having the black Cr—Co alloy plating film in the blackening treatment solution.

5. The method according to claim 1, wherein the black Cr—Co alloy plating film contains 5 to 15 wt. % of phosphorus.

6. A blackening treatment method for a black Cr—Co alloy plating film, the method comprising performing electrolytic chromate treatment after performing blackening treatment of a black Cr—Co alloy plating film by the method according to claim 1.

7. The blackening treatment method according to claim 1, wherein the blackening treatment solution comprising an aqueous solution with a pH value of −1 to 5 contains an inorganic acid as an acid component, and the inorganic acid is at least one member selected from the group consisting of hydrochloric acid, sulfuric acid, nitric acid, phosphoric acid, hydrofluoric acid, and boric acid.

8. The blackening treatment method according to claim 1, wherein the blackening treatment solution comprising an aqueous solution with a pH value of −1 to 5 contains an organic acid as an acid component, and the organic acid is at least one member selected from the group consisting of aliphatic monocarboxylic acids, aliphatic dicarboxylic acids, aliphatic hydroxy monocarboxylic acids, aliphatic hydroxy dicarboxylic acids, and aliphatic hydroxy tricarboxylic acids.

9. The blackening treatment method according to claim 3, wherein the amount of the organic acid and/or inorganic acid in the blackening treatment solution is 1 to 100 g/L.

10. The blackening treatment method according to claim 7, wherein the amount of the inorganic acid in the blackening treatment solution is 1 to 100 g/L.

11. The blackening treatment method according to claim 8, wherein the amount of the organic acid in the blackening treatment solution is 1 to 100 g/L.

12. The method according to claim 1, wherein the black Cr—Co alloy plating film contains phosphorus.

13. The method according to claim 1, wherein the black Cr—Co alloy plating film after blackening treatment has a reflectance of 20% or less measured by a colorimeter in the wavelength range of 400 to 700 nm.

* * * * *